US005096074A

United States Patent [19]

Merl

[11] Patent Number: 5,096,074

[45] Date of Patent: Mar. 17, 1992

[54] EXPANDABLE BASE SHELF ASSEMBLY FOR DISPLAY GONDOLAS

[75] Inventor: Milton Merl, New York, N.Y.

[73] Assignee: Marlboro Marketing, Inc., New York, N.Y.

[21] Appl. No.: 477,059

[22] Filed: Feb. 7, 1990

[51] Int. Cl.[5] ..... A47F 5/00

[52] U.S. Cl. ..... 211/175; 211/186; 108/102

[58] Field of Search ..... 211/175, 59.2, 186, 211/128; 108/102, 143

[56] References Cited

U.S. PATENT DOCUMENTS

| | | | |
|---|---|---|---|
| 3,685,687 | 8/1972 | Eckdahl | 211/128 X |
| 3,894,634 | 7/1975 | Gotham et al. | 211/186 X |
| 4,540,222 | 9/1985 | Burrell | 211/175 X |
| 4,602,570 | 7/1986 | Lee | 108/102 |
| 4,776,472 | 10/1988 | Rosen | 211/175 X |

*Primary Examiner*—Blair M. Johnson
*Attorney, Agent, or Firm*—Darby & Darby

[57] ABSTRACT

Shelving for supporting merchandise includes a sloping base shelf that extends outwardly from a gondola wall and slightly upwardly toward a shopping aisle. The base shelf is supported by a framework that rests upon the floor. An extension shelf is mounted on a framework that is slidably mounted to the base shelf. The extension shelf and base shelf are substantially parallel and spaced apart. A pin on the frame of the extension shelf is selectably positioned in any of a plurality of stop positions provided on the base shelf framework. In a first position in the base shelf overlies the extension shelf and in a second position the extension shelf extends beyond the base shelf into the aisle. Where a large inventory is desired on the selling floor, the base shelf surface is supplemented by pulling out the extension shelf from beneath the base shelf. A grid of spaced rods extends perpendicularly from the base shelf until it contacts the back wall of the gondola, providing a sloping surface against which the product leans while standing on the sloped base shelf.

8 Claims, 2 Drawing Sheets 10
18
20
22
30
32
36
38
40
42
44
46
48
52
54
56
58
60
62
64
68
70
72
74
75
77
79
80
82
84
86

EXPANDABLE BASE SHELF ASSEMBLY FOR DISPLAY GONDOLAS

BACKGROUND OF THE INVENTION

This invention relates generally to a merchandise display device for supporting merchandise thereon, and more particularly concerns an expandable base shelf assembly for use with gondolas as conventionally used in supermarkets for display of merchandise. Traditional store shelving, or as it is called, gondola shelving, is designed to arrange a product in a horizontal format. Existing store shelving includes metal shelves, hooking onto vertical uprights, known as standards, that have a series of punched slots in which hooks, attached to the metal shelves, are engaged. This is similar to conventional wall type bookshelves. The shelves extend perpendicularly from the back wall of the gondola and are adjustable vertically in steps within the range of approximately 2 to 2½ inches per step depending upon the vertical spacing of the punched slots in the standards. The conventional shelves have a depth which ranges from approximately 16 to 26 inches. Research has shown that a vertical arrangement of merchandise, that is, packages stacked one on top of the other, top end to bottom end, tends to enhance the impact of a brand or group of products within a brand. This results because consumers can view all of these products at once as opposed to having to walk an extended distance along an aisle when there are a large number of items in a particular category and the items are arranged horizontally. For example, in a supermarket, coffee can be displayed in an aisle along a length of an aisle that averages anywhere from 8 feet to 40 feet. Obviously, as the section gets longer for a given type product, shopability becomes more and more difficult. Thus, the inconvenience in shopping a particular brand of product is greater when the product is displayed horizontally as compared to a vertical format.

Additionally, a typical six foot high gondola is set up conventionally with six to seven shelves. The thickness of the shelves per se, takes up space that could be used for product and also, there must be a space underneath each shelf that is necessary to remove the product on the shelf below. Thus, as much as 2½ inches can be used vertically just to put a single shelf in place and to allow finger clearance between the top of the product and the shelf above so that product may be pulled out from underneath the shelf. This "wasted" space increases as the number of shelves increase.

Another problem arises when a product is being especially promoted, e.g. on sale, when it is desired to have a larger than normal quantity of the product on display on the aisle. Conventionally, this increased quantity is accommodated by using shelves of greater depth, spreading the display horizontally in the unlikely event that such space is available, and by stacking large cartons of the product in the aisle space near the shelved display. Shoppers carts have difficulty in negotiating such randomly obstructed aisles.

Also, as the merchandise is removed by purchase from the gondola, the shelves of extra depth remain until the merchandise is replaced even though they are substantially unloaded.

Modifying the shelving just for these special promotional events is inconvenient and costly to the merchandiser.

What is needed is a shelving arrangement that provides more space in a gondola for merchandise and allows for variation in depth of the merchandise display.

SUMMARY OF THE INVENTION

Accordingly, it is an object of this invention to provide an improved shelving assembly for display gondolas that provides an extendable and retractable supplemental support surface for product.

Another object of this invention is to provide shelving assembly that eliminates most of the waste space inherent in using conventional gondola shelving.

Yet another object of this invention is to provide an improved shelving assembly that allows a vertical presentation of product and reduces the aisle length of the required display.

Generally speaking, the shelving in accordance with the invention, for supporting merchandise, includes a sloping base shelf that extends outwardly from the gondola rear wall surface slightly upwardly toward the shopping aisle. The base shelf is supported by hollow tubes or channels that rest upon the floor. An extension shelf is mounted on a framework of hollow tubes that are slidably mounted to the floor channels of the base shelf. The extension shelf also slopes upwardly at approximately the same angle as the base shelf. A pin on the frame of the extension shelf is selectably positioned in any of a plurality of stop positions provided on the base shelf framework. In a first position the base shelf overlies the extension shelf and in a second position the extension shelf extends beyond the base shelf into the aisle. The shelves, although substantially parallel, are not coplanar and a vertical gap, that increases as the assembly extends, separates the two support surfaces.

Thus, for a special sale of merchandise, where a large inventory is desired on the selling floor, the base shelf surface is supplemented by pulling out the extension shelf from beneath the base shelf to any one of a plurality of positions depending on the quantity of additional shelf space desired. The extension shelf can remain in such extended position until the merchandise is removed or sold, after which the extension shelf may be readily retracted by disengaging the pin from the stop position on the base shelf framework.

A grid of spaced rods extends perpendicularly from the sloping base shelf until it contacts the back wall of the gondola. Thus, a sloping surface is provided against which the product leans while standing on the sloped base shelf. Because the sloped support surface tilts the product toward the gondola wall, high stacking is possible without the conventional intermediate shelves. A boxed product is less likely to fall forward when it is initially tilted back. Therefore, more product may be stacked vertically and remain stable.

A guard rail at the front, that is, facing the aisle, of the extension shelf protects the merchandise from shoppers carts and assures that merchandise does not fall into the aisle. The expandable base shelf assembly is conveniently positioned between a pair of adjacent uprights on a gondola although a greater length along the aisle can be provided. The conventional horizontal gondola shelves are eliminated so that a fully packed vertically oriented display, without interruption, can be provided.

On the other hand, additional adjustable shelves may be added along the vertical height of the gondola uprights for special promotional effects or to handle a particular category of product in the same brand as displayed on the expandable base shelf assembly.

Other objects, features and advantages of the invention will be apparent from the specification. This invention accordingly comprises the features of construction, combination of elements and arrangement of parts that will be exemplified in the constructions hereinafter set forth, and the scope of the invention will be indicated in the appended claims.

BRIEF DESCRIPTION OF THE DRAWINGS

For a fuller understanding of the invention, reference is made to the following description taken in connection with the accompanying drawings, in which.

DESCRIPTION OF THE PREFERRED EMBODIMENTS

An expandable base shelf assembly 10 includes a base shelf assembly 12 and an extension shelf assembly 14 that are intended for use with a conventional shopping market gondola 16.

Figure 1:
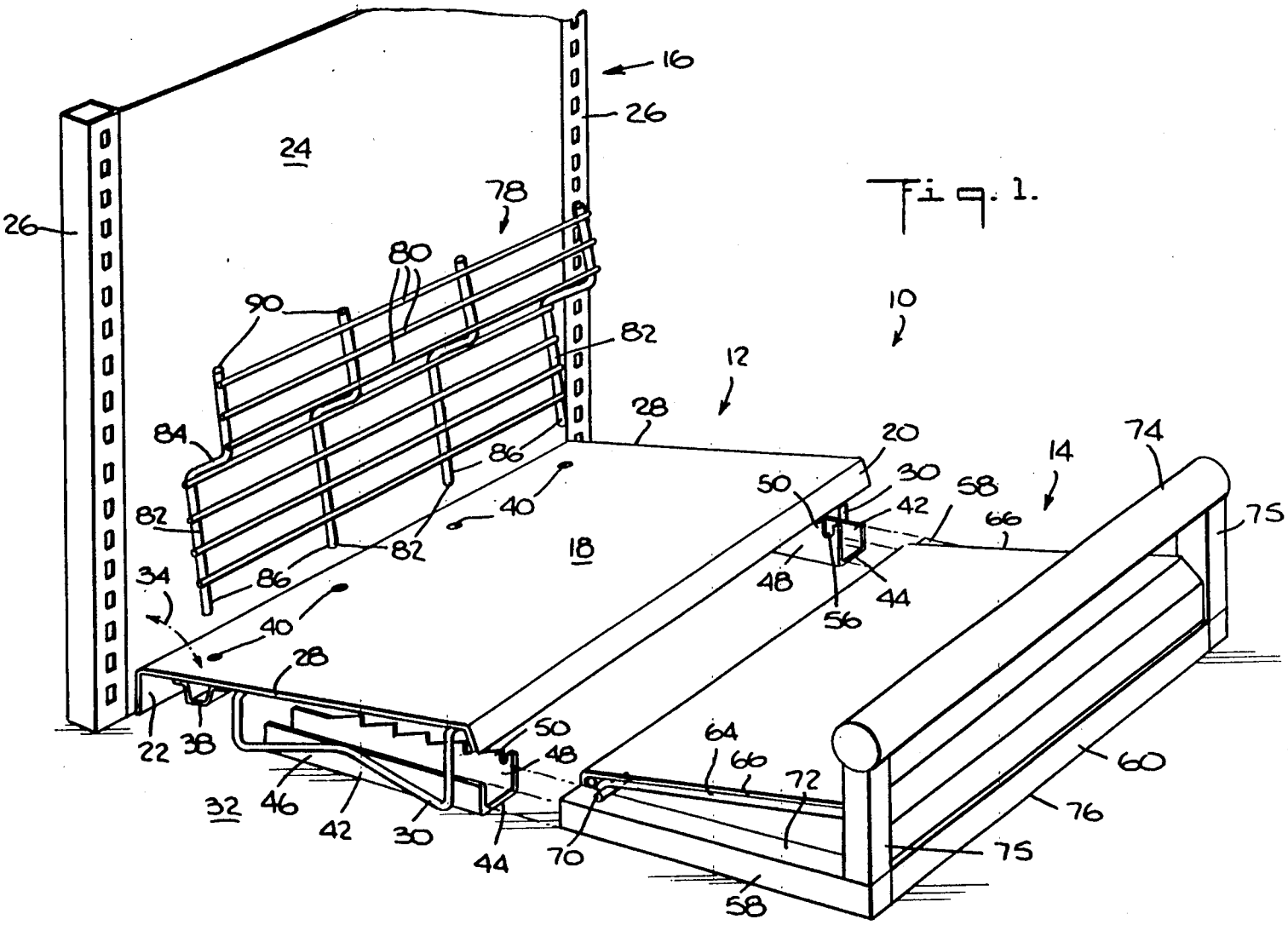
FIG. 1 is a top perspective exploded view of an expandable base shelf assembly in accordance with the invention.

The base shelf assembly 12 includes a planar support surface 18 having an outer downturned apron 20 and an inner downturned apron 22. The lower edge of the inner apron 22 is intended to rest upon the floor 32 or other base of the gondola 16 with the planar surface of the apron 22 pressing against the back wall 24 of the gondola. In FIG. 1, the base shelf assembly 12 fits between a pair of vertical uprights or standards 26 of the gondola.

The lateral edges 28 of the support surface 18 are supported by a bent wire strut 30, which makes two contacts with the support surface 18 and two contacts with the floor 32. The strut 30 supports the surface 18 at a upward angle relative to the back wall 24 of the gondola such that the included angle 34 between them is less than 90°. A pair of U-shaped channels 36 are connected to the underside of the planar support surface 18 and add rigidity thereto. Another U-shaped channel 38 is located beneath the planar support surface 18 close to the inner apron 22. The channel 38 is positioned in alignment with a plurality of holes 40 that are formed through the planar support surface 18 for purposes described more fully hereinafter.

Figures 2, 3:
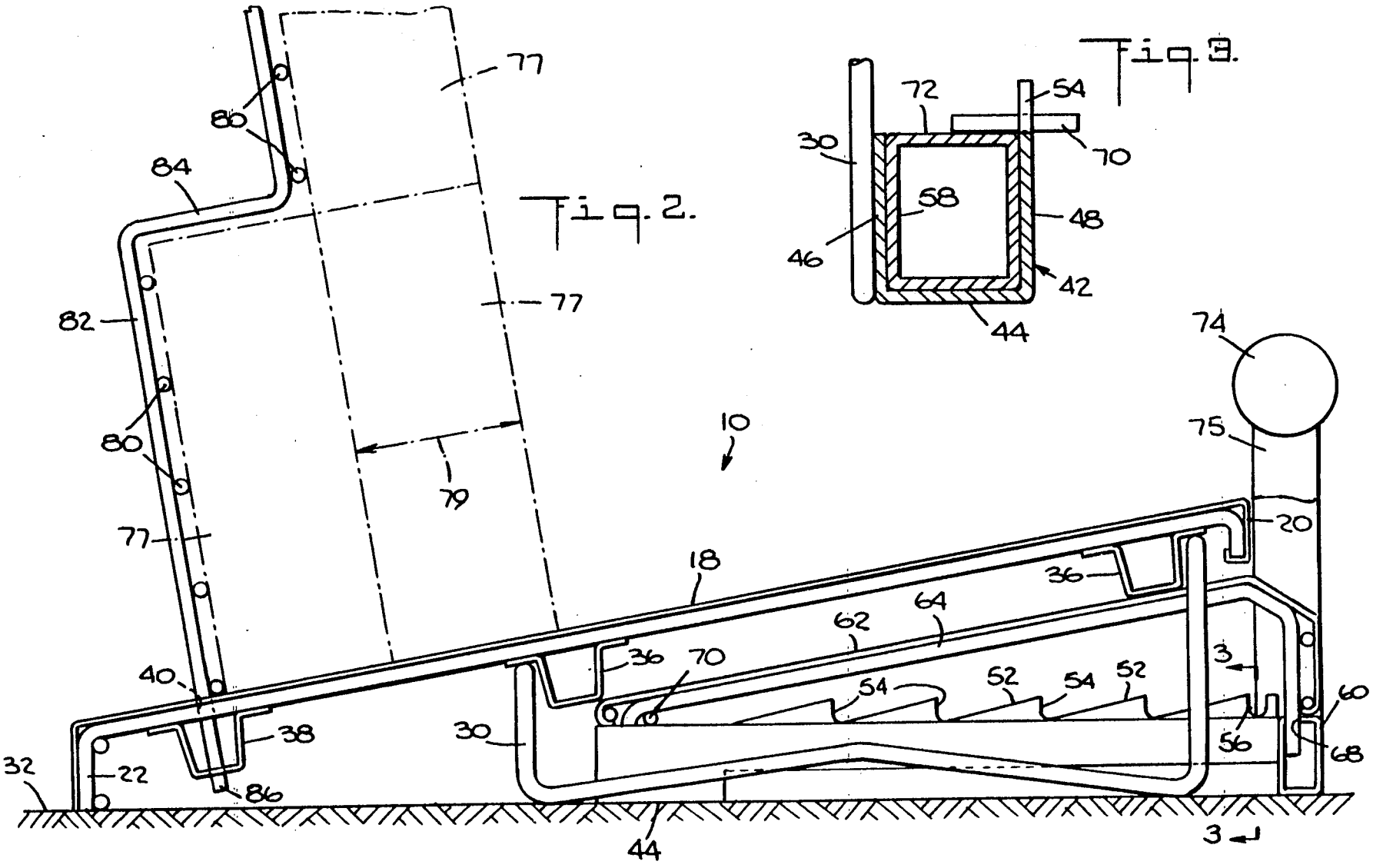
FIG. 2 is a partial side elevational view of the expandable base shelf assembly of FIG. 1.
FIG. 3 is a partial view, in section, of the assembly of FIGS. 1 and 2 taken along the line 3—3 in FIG. 2.

Channels 42, each having a flat surface 44 for resting on the floor 32, are fixedly attached to a bent wire strut 30 connected on each side of the support surface 18. The outer arm 46 of the channel 42 is rectangular and the inner arm 48 includes a plurality of regularly spaced ramps or sawteeth 50. The sawteeth 50 extend above the level of the rectangular outer arm 46 (FIG. 2). Each tooth includes a ramp 52 sloping upward toward the outer apron 20 with a substantially perpendicular trailing edge 54 between each tooth. A notch 56 is formed in the inner arm 48 outward of the most forward tooth 50, with the perpendicular edge 54 of that tooth 50 forming one side of the notch 56.

The extension shelf assembly 14 includes at each side a pair of rectangular tubes 58, only one of which is visible in the drawings. The tubes 58 are connected by an intermediate cross tube 60 that provides rigidity to the structure. Each tube 58 slides in a channel 42 between the outer arm 46 and inner arm 48.

A planar extension surface 62 is attached to the base structure 58, 60 at the inner ends of the tubes 58, and to the cross tube 60 at the outer end of the planar surface 62. A frame or bent rod 64 supports the planar surface 62 from beneath near each lateral edge 66, and is bent to a vertical orientation. The end of the rod enters an opening 68 in the top surface of the front piece 60 (FIG. 2). At the rear, the rod 64 is bent down vertically and connected to the tube 58. When the tubes 58 are fully telescoped within the channels 42, the planar extension surface 62 is at an angle such that the support surface 62 is substantially parallel to the planar support surface 18.

A handle 74 is connected by vertical end posts 75 to the rectangular tubes 58. This handle 74 extends above the sloped planar surfaces 18, 62 and serves many functions. The handle 74 is the grip that a person uses in extending the extension shelf assembly 14 from beneath the base shelf assembly 12. The handle 74 also acts as a retainer rail to help keep the product from falling into the aisle where shoppers are walking, and the handle 74 acts as a guardrail to protect the product from accidental impacts by shopping carts as they move up and down the aisles.

A locking pin 70 is connected to the top surface 72 of each rectangular tube 58 and extends inwardly beneath the planar surface 62 such that when the tubes 58 are respectively telescoped within the channels 42, the pins 70 are positioned on the top edge of the inner arm 48 near the inner end of the plurality of sawteeth 50 on the inner arm 48. When the extension shelf assembly 14 is slid outwardly, the locking pin 70 makes contact with the ramp 52 of the first inner tooth 50, slides up the ramp 52 and drops at the perpendicular trailing edge 54 to the base of the next tooth. Upon further pulling in the outward direction, the locking pins 70 rides up the ramp 52 of the next adjacent tooth 50 until it passes the perpendicular trailing edge 54 of that tooth and drops to the base of the next tooth. Thus, the extension shelf assembly 14 is easily pulled out, by gripping the handle 74, to any desired extension in increments based upon the periodic spacing of the teeth 50. When the locking pin 70 moves past the perpendicular edge 54 of the outermost tooth 50, the pin 70 falls into a notch 56 and further pulling in the outward direction does not further displace the extension shelf assembly 14. Thus, it is not possible to pull the extension shelf assembly 14 so far out from the gondola 16 that it separates from the base shelf assembly 12. In each position, the pin 70, resting against the trailing edge 54, prevents the extension shelf assembly from moving inwardly.

To return the extension shelf assembly to its innermost position or any other intermediate position from the outermost position, the extension shelf assembly 14 is pivoted around the edge 76 acting as a fulcrum by grasping the handle 74 and swinging it in a outward and downward arc. By so doing, the rear ends of the tubes 58 are lifted from the base of the channels 42 until the pin 70 is disengaged from the notch 56 or is elevated above the apex on any tooth 50. Then, in this tilted position, the extension shelf assembly 14 is pushed back to its desired position, including the fully retracted position.

Thus, the tubes 58 of the extension shelf assembly 14 supportedly engage, e.g. slidingly or telescopingly coact with, the channels 42 of the base assembly 12 so as to support the extension shelf assembly 14 on the base shelf assembly 12 in any position of movement of the extension shelf assembly 14 relative to the base shelf assembly 12 between the innermost position and outermost position of the extension shelf assembly 14.

In a shelf assembly 10 that is customized to a particular product package 77, the length of the tooth ramp 52 approximately equals the depth 79 of the package 77. Thus, an additional column of product is possible for each outward extension from one tooth 50 to the next.

As the extension shelf assembly 14 slides outwardly, a vertical gap opens progressively between the lower edge of the front apron 20 on the base shelf assembly 12 and the sloped planar support surface 62 of the extension shelf assembly 14. Product 77 (not shown) when placed on the sloped extension shelf surface 62 is supported from the rear by leaning against the apron 20. Thus, product stacking stability is provided by the tiered relationship of the substantially parallel, but separated, surfaces 18, 62. Advantageously, the gap or step between the two support surfaces increases with the increased degree of extension so as to accommodate a greater loading of product with stability.

A grid assembly 78 includes a plurality of transverse rods 80 having substantially the same length as the planar support surface 18. The rods 80 are connected together in two tiers by means of support rods 82 that are spaced at the longitudinal ends of the transverse rods 80 and at intermediate locations to give rigidity to the structure. A step or offset 84 in the support rods 82 sets a portion of the transverse rods 80 in a plane spaced from, but parallel to the plane of the remaining rods 80. These support rods 82 have extensions 86 beyond the first transverse rod 80 and the extensions 86 pass through the holes 40 in the planar support surface 18. As best illustrated in FIG. 2, the ends or extensions 86 pass through the base 88 of the channel 38 beneath the support surface 18 such that a cantilever type connection is provided between the grid assembly 78 and the base shelf assembly 12. The support rods 82 extend away from the support surface 18, substantially at a right angle thereto. When the base shelf assembly 12, with the grid assembly 78 attached, is positioned adjacent to a gondola 16, as illustrated in FIG. 1, the upper ends 90 of the support rods 82 rest against the back wall 24 of the gondola 16.

The offset 84 is positioned on the grid assembly 78 such that an integral number (1, 2, 3 . . . ) of product packages 77, stacked on top of one another, facing the front of the unit, fit against the grid assembly 78 in the space between the planar support surface 18 and the offset 84.

Thus, an arrangement of shelves is provided which is extendable as required for the product and for particular promotions, such as sales. The extension can readily be reduced as product is sold so as to produce less interference in the aisle. Conventional shelving is entirely eliminated such that the space that shelves conventionally fill is now available for product. Good visibility is provided for the product, even when only a few packages remain, because the conventional shelves are not present to obstruct the view and the product tilts back for better viewing. Because there is no need for intermediate shelving, a vertical display format is feasible.

It will thus be seen that the objects set forth above, among those made apparent from the preceding description, are efficiently attained and, since certain changes may be made in the above constructions without departing from the spirit and scope of the invention, it is intended that all matter contained in the above description and shown in the accompanying drawings shall be interpreted as illustrative and not in a limiting sense. It is also to be understood that the following claims are intended to cover all of the generic and specific features of the invention herein described and all statements of the scope of the invention that might be said to fall therebetween.

What is claimed is:

1. An expandable base shelf assembly for use with a vertical surface and a horizontal surface to support a product on display, comprising:

a base shelf assembly for resting on said horizontal surface, said assembly including a first support surface elevated above said horizontal surface, said first support surface having an inner end intended to be adjacent said vertical surface and an outer end, and first support means for engaging said horizontal surface and for holding said first support surface in said elevated position;

an extension shelf assembly including a second support surface elevated above said horizontal surface, said extension shelf assembly being movable in the end-to-end direction of said first support surface between a first position where substantially the entire second support surface is beneath said first support surface with a vertical gap therebetween and a second position where said second support surface extends substantially beyond said outer end of said first support surface, said first and second support surfaces lying in different planes with said gap increasing as extension of said extension shelf assembly increases, and second support means for engaging said first support means and for holding said second support surface in said elevated position, said second support means supportedly engaging said first support means for supporting said extension shelf assembly on said base shelf assembly in any position of movement in said end-to-end direction of said extension shelf assembly relative to said base shelf assembly; and positioning means interengaging said base shelf assembly and said extension shelf assembly for releasably maintaining said second support surface in a selected one of said first and second positions and at intermediate positions.

2. An expandable base shelf assembly as in claim 1, wherein said first and second support surfaces are maintained substantially parallel to each other.

3. An expandable base shelf assembly as in claim 2, wherein said support surfaces are angled upward in the direction from said inner end towards said outer end of said first support surface.

4. An expandable base shelf assembly as in claim 1, wherein said second support means of said extension shelf assembly slidingly engages said first support means of said base shelf assembly.

5. An expandable base shelf assembly for use with a vertical surface and a horizontal surface to support a product on display, comprising:

a base shelf assembly for resting on said horizontal surface, said assembly including a first support surface elevated above said horizontal surface, said first support surface having an inner end intended to be adjacent said vertical surface and an outer end, and first support means for engaging said horizontal surface and for holding said first support surface in said elevated position;

an extension shelf assembly including a second support surface elevated above said horizontal surface, said extension shelf assembly being movable in the end-to-end direction of said first support surface between a first position where substantially the entire second support surface is beneath said first support surface with a vertical gap therebetween and a second position where said second support surface extends substantially beyond said outer end of said first support surface, said first and second support surfaces lying in different planes with said gap increasing as extension of said extension shelf assembly increases, and second support means for engaging said first support means and for holding said second support surface in said elevated position; and positioning means interengaging said base shelf assembly and said extension shelf assembly for releasably maintaining said second support surface in a selected one of said first and second positions and at intermediate positions, said positioning means including pin means on said extension shelf assembly and saw-tooth means on said base shelf assembly, the position of said extension shelf assembly relative to said base shelf assembly being established by the engagement of said pin means with said saw-tooth means.

6. An expandable base shelf assembly as in claim 5, wherein said pin means is a pin on said extension shelf assembly, said pin extending at a right angle to the direction of shelf extension, and said saw-tooth means includes a succession of ramps sloping upwards from said inner end toward said outer end, the trailing edges of said ramps being substantially at a right angle to said horizontal surface when said expandable base shelf assembly is resting on said horizontal surface, said pin sliding over said sawtooth profile as said extension shelf moves from said first position to said second position, said trailing edges engaging said pin blocking return motion of said extension shelf assembly, said ramps resisting motion in the outward direction.

7. An expandable base shelf assembly as in claim 6, wherein the lengths of said ramps correspond with the depth of the product package to be stacked vertically on said base shelf assembly.

8. An expandable base shelf assembly as in claim 1, and further comprising a bar connected to said extension shelf assembly at the outer end thereof, said bar being positioned beyond the outer end of said first support surface and elevated higher than said first support surface, said bar serving as a handle for changing the relative positions between said base shelf assembly and said extension shelf assembly, and as a protective guard for product stored on said expandable base shelf assembly.

* * * * *